United States Patent [19]

Goubeaux et al.

[11] Patent Number: 5,009,074

[45] Date of Patent: Apr. 23, 1991

[54] LOW REFRIGERANT CHARGE PROTECTION METHOD FOR A VARIABLE DISPLACEMENT COMPRESSOR

[75] Inventors: Ronald J. Goubeaux, Lockport; Edward D. Pettitt, Burt, both of N.Y.

[73] Assignee: General Motors Corporation, Detroit, Mich.

[21] Appl. No.: 562,100

[22] Filed: Aug. 2, 1990

[51] Int. Cl.[5] ..... F25B 49/02

[52] U.S. Cl. ..... 62/115; 62/126; 62/129

[58] Field of Search ..... 62/115, 126, 129, 157, 62/158

[56] References Cited

U.S. PATENT DOCUMENTS

| | | | |
|---|---|---|---|
| 4,167,858 | 9/1979 | Kojema et al. | 62/129 X |
| 4,328,678 | 5/1982 | Kono et al. | 62/126 |
| 4,344,293 | 8/1982 | Fujiwara et al. | 62/129 X |
| 4,463,576 | 8/1984 | Burnett et al. | 62/228.3 |
| 4,677,836 | 7/1987 | Sumikawa et al. | 62/126 |
| 4,966,013 | 10/1990 | Wood | 62/126 X |

*Primary Examiner*—William E. Tapolcai
*Attorney, Agent, or Firm*—Mark A. Navarre

[57] ABSTRACT

A low charge protection method for an electronically controlled variable displacement compressor. In each period of compressor operation, a low charge test sequence is carried out to monitor the system performance once the system control pressure has been reduced below a specified level. In a set-up phase of the test, the compressor is down-stroked to near-minimum displacement for a predetermined time or until the system control pressure rises above a reference level. At such point, the compressor is up-stroked to near-maximum displacement to initiate a pull-down phase of the test. If the system pressure is reduced by specified amount within a reference interval, a failed test is indicated and the count in a nonvolatile counter is incremented. If the pull-down duration exceeds the reference interval, a passed test is indicated, and the count, if any, is decremented. When the nonvolatile count exceeds a specified threshold, the compressor is disabled and further operation is prevented until the count is reset by a service technician.

6 Claims, 4 Drawing Sheets

LOW REFRIGERANT CHARGE PROTECTION METHOD FOR A VARIABLE DISPLACEMENT COMPRESSOR

This invention pertains to the control of a variable displacement air conditioning system compressor, and more particularly, to a control method which protects against compressor damage due to a low refrigerant charge condition.

BACKGROUND OF THE INVENTION

Variable displacement refrigerant compressors have been employed in engine driven automotive air conditioning systems in order to reduce engine load variations associated with compressor cycling. In the system manufactured by the Harrison Radiator Division of General Motors Corporation, for example, the compressor displacement is controlled by regulating the compressor crankcase pressure To this end, a pneumatic control valve integral to the compressor variably connects the compressor crankcase to the inlet (suction) and outlet (discharge) chambers of the compressor. In an electronic version of the control, the control valve is mechanized with a solenoid valve positioned to achieve the ratiometric control. The valve may be linearly positioned by controlling the solenoid current, or pulse-width-modulated at a variable duty cycle to alternately connect the crankcase to the inlet and outlet chambers.

As with fixed displacement compressors, internal lubrication is provided by a small amount of oil suspended in the refrigerant The amount of refrigerant in the system, referred to herein as the refrigerant charge, therefore determines the degree of compressor lubrication as well as the cooling performance of the system. If a significant portion of the refrigerant escapes, compressor lubrication may be insufficient and continued operation under such conditions may severely damage the compressor.

Various arrangements have been proposed for detecting the refrigerant charge in an air conditioning system and for taking the appropriate protective action when a low charge condition occurs. One such system for a fixed displacement compressor is disclosed in the Burnett U.S. Pat. No. 4,463,576, et al. issued Aug. 7, 1984, and assigned to the assignee of the present invention. In that system, the compressor is cycled on and off as a function of the refrigerant vapor pressure, and a low charge condition is indicated when a specified number of successive short duration on-periods occur. This method is effective in the protection of cycled fixed displacement compressors, but is not applicable to variable displacement compressors since variable displacement compressors are not cycled on and off in normal operation. Various refrigerant level measuring devices have also been proposed.

SUMMARY OF THE PRESENT INVENTION

The present invention is directed to an improved low charge protection method for an electronically controlled variable displacement compressor. In each period of compressor operation, a low charge test sequence is carried out to monitor the system performance once the system control pressure has been reduced below a specified level. In a set-up phase of the test, the compressor is down-stroked to near-minimum displacement for a predetermined time (such as 20 seconds) or until the system control pressure rises above a reference level. At such point, the compressor is up-stroked to near-maximum displacement to initiate a pull-down phase of the test. If the system pressure is reduced by a specified amount, such as 20 PSI, within a reference interval such as 6 seconds, a failed test is indicated and the count in a nonvolatile counter is incremented, If the pull-down duration exceeds the reference interval, a passed test is indicated, and the count, if any, is decremented. When the nonvolatile count exceeds a specified threshold, the compressor is disabled and further operation is prevented until the count is reset by a service technician.

DETAILED DESCRIPTION OF THE INVENTION

Figure 1:
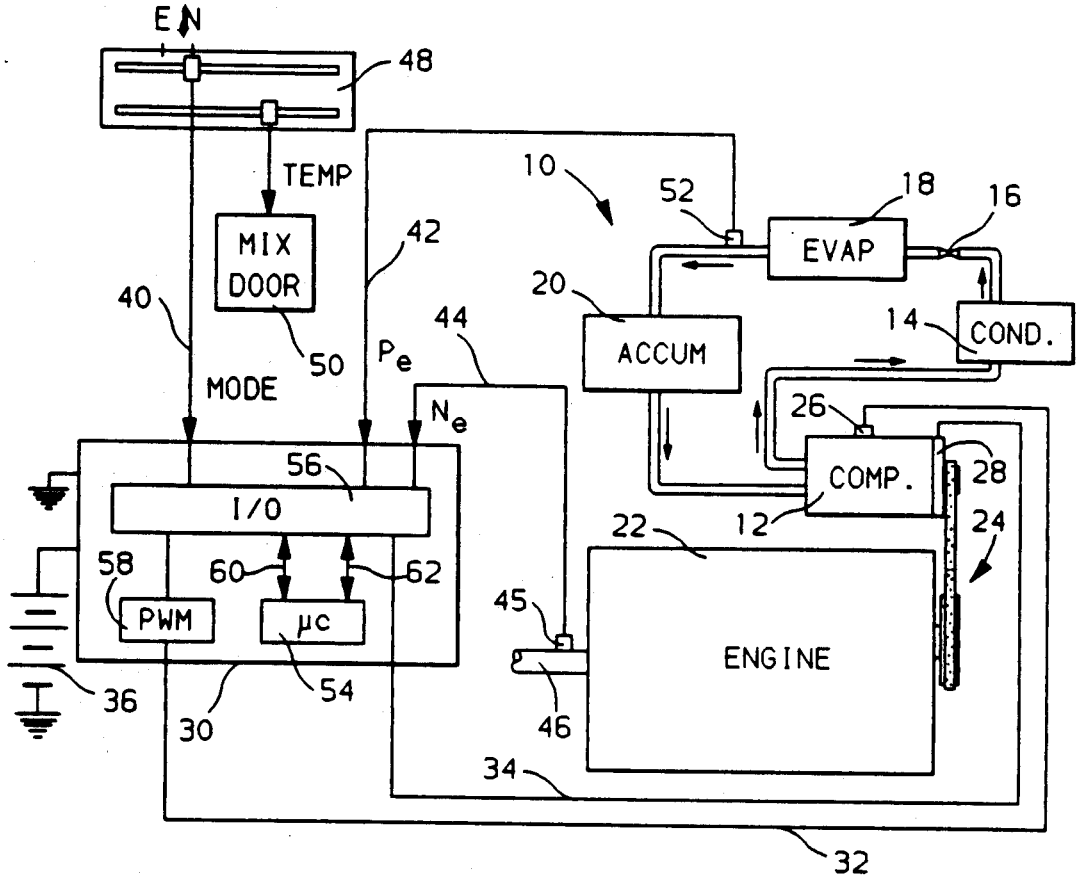
FIG. 1 is a block diagram of an automotive air conditioning system in accordance with the present invention, including a computer-based electronic control unit.

Referring to FIG. 1, the reference numeral 10 generally designates an automotive air conditioning system including a variable displacement refrigerant compressor 12, a condenser core 14, an expansion orifice 16, an evaporator core 18 and an accumulator 20. The compressor 12 is driven by the vehicle engine 22 via a belt and pulley drive arrangement generally designated by the reference numeral 24. For control purposes, the compressor 12 includes a pulse-width-modulated (PWM) solenoid valve 26 for alternately connecting the crankcase of compressor 12 to the inlet (suction) and outlet (discharge) pressures of the compressor at a controllable duty cycle. This effects a ratiometric control of the crankcase pressure between the inlet and outlet pressures, which in turn, controls the displacement of the compressor 12. An electro-magnetic clutch 28 is controlled to selectively engage and disengage the pulley drive arrangement 24. An electronic control unit 30 controls the operation of the solenoid valve 26 and clutch 28 via lines 32 and 34, as explained below.

In the illustrated embodiment, the PWM duty cycle applied to solenoid valve 26 is inversely related to the resultant change in compressor displacement. That is, relatively high duty cycle energization of the solenoid valve 26 serves to decrease the capacity of, or destroke, the compressor 12, while relatively low duty cycle energization serves to increase the capacity of the compressor 12. An intermediate duty cycle energization in the range of approximately 50%–70% maintains the current capacity In operation, warm pressurized gaseous refrigerant discharged from the engine driven compressor 12 is cooled and liquefied by the condenser 14, which is typically air cooled. The orifice 16 rapidly decreases in the pressure of the condensed refrigerant, effecting further cooling of the same prior to its entry into the evaporator 18. When the refrigerant is at a normal charge level, the refrigerant supplied to the inlet of evaporator 18 is predominantly liquid. Warm air flowing across the evaporator 18 vaporizes or boils the cooled refrigerant therein, thereby cooling the passenger compartment. The warmed refrigerant is then discharged to the accumulator 20, which separates out the gaseous portion for return to the inlet of compressor 12.

The control unit 30 is powered by the vehicle storage battery 36, and generates control signals for the compressor 12 and clutch 28 on lines 32 and 34 in response to various input signals received on lines 40–44. The MODE signal on line 40 is obtained from an operator manipulated control head 48, by which the operator designates the desired operating mode: normal (N) or economy (E). The control head 48 also serves to position a mix door 50 for regulating the temperature of the conditioned air supplied to the passenger compartment. The pressure signal $P_e$ on line 42 is generated by a pressure transducer 52 mounted at the outlet of evaporator 18 to sense the pressure of the gaseous refrigerant therein. Finally, the speed signal $N_e$ on line 44 is generated by a speed sensor 45 responsive to the rotary speed of the output shaft 46 of engine 22.

In operation, the control unit 30 uses the MODE and $N_e$ signals on lines 40 and 44 to develop a control setting, designated herein as a pressure command PCMD for the outlet of the evaporator 18. The pressure signal $P_e$ on line 42 is used as a feedback parameter, and the control unit 30 energizes the solenoid valve 26 via line 32 at a duty cycle chosen to bring the measured pressure signal $P_e$ into correspondence with the pressure command PCMD. In other words, the compressor displacement is controlled as required to maintain the evaporator outlet pressure Pe at the commanded value PCMD.

According to this invention, the control unit 30 also carries out a test sequence for determining if the refrigerant charge is adequate to protect the compressor 12. The test sequence is outlined above and described in detail below in reference to FIGS. 2 and 3A–3B.

Internally, the control unit 30 comprises a microcomputer (uC) 54 with both volatile and nonvolatile memory, an Input/Output (I/O) device 56, a pulse-width modulation (PWM) driver 58, an address and control bus 60 and a data bus 62. The I/O device 56 receives the inputs on lines 40–44, and under the control of microcomputer 54, supplies a duty cycle command to the PWM driver 58. Flow diagrams representative of the program instructions executed by the microcomputer 54 in carrying out the compressor control and the test sequence of this invention are described below in reference to FIGS. 3A–3C.

Figure 2:
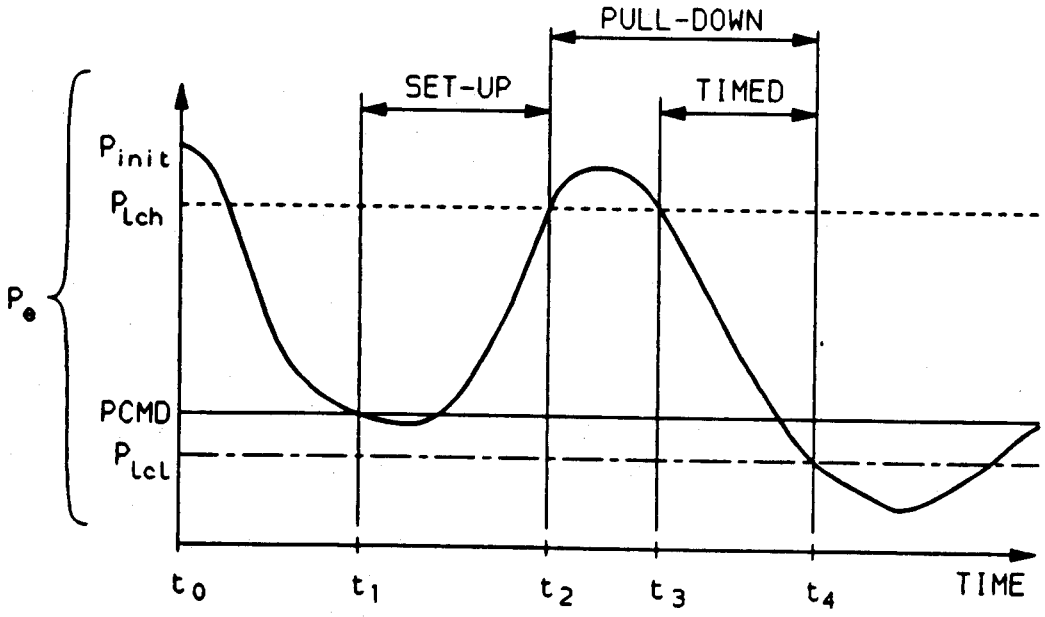
FIG. 2 is a graph depicting the evaporator pressure in a low charge test according to this invention.

A typical period of operation according to the present invention is graphically illustrated in FIG. 2, where the evaporator outlet pressure $P_e$ is plotted as a function of time. Compressor operation is initiated by energizing clutch 28 at time $t_0$, with $P_e$ at an initial relatively high value $P_{init}$. The pressure error, PCMD - $P_e$, is large, and the control unit 30 up-strokes the compressor 12 to maximize the air conditioning performance. When the evaporator pressure Pe reaches the command value PCMD at time $t_1$, the set-up phase of the low charge test sequence is initiated.

The time required to reach the command pressure PCMD—that is, the interval $t_0$-$t_1$—depends on the ambient temperature and humidity, the evaporator load (fan speed), compressor speed, and the refrigerant charge. Under low ambient, low load conditions with normal refrigerant charge, as little as 0.5 seconds may be sufficient. Under high ambient or high load conditions with normal refrigerant charge, as much as 15–20 minutes may be required. In either case, the maximum possible air conditioning performance is achieved before the low charge test sequence is initiated.

Commencing at time $t_1$, the control unit 30 initiates the set-up phase of the test sequence, down-stroking compressor 12 to near-minimum displacement. This permits the evaporator outlet pressure $P_e$ to increase, as indicated in the interval $t_1$-$t_2$. Once again, the rate of increase depends on the ambient temperature and humidity, the evaporator load (fan speed), compressor speed and the refrigerant charge. Under high ambient or high load conditions with normal refrigerant charge, the pressure rises quickly and may reach the entry pressure $P_{LCH}$ in as little as 6.0 seconds. Under low ambient, low load conditions with normal refrigerant charge, however, the pressure may never reach the entry pressure $P_{LCH}$. For these conditions, the control unit 30 initiates the next (pull-down) phase of the test after a down-stroke time-out of 20 seconds.

Commencing at time $t_2$, the control unit 30 initiates the pull-down phase of the test sequence, up-stroking the compressor 12 to near-maximum displacement. This produces a decrease in the evaporator outlet pressure $P_e$, as indicated in the interval $t_2$-$t_4$. The pull-down phase is terminated at time $t_4$ when the compressor 12 has reduced $P_e$ by a specified differential, such as 20 PSI. If $P_e$ reaches the entry pressure $P_{LCH}$ within the 20-second time-out, as shown in FIG. 2, the pull-down is terminated when $P_e$ reaches an exit threshold $P_{LCL}$, 20 PSI lower than $P_{LCH}$. If the pull-down was initiated at the expiration of the 20-second time-out, the pull-down is terminated after an evaporator pressure reduction of 20 PSI without regard to the predefined entry and exit pressures $P_{LCH}$ and $P_{LCL}$. In practice, the terms $P_{LCH}$ and $P_{LCL}$ are redefined under such conditions so that the evaporator pressure achieved at the termination of the time-out interval, $t_2$, becomes the entry pressure, as described below in reference to FIG. 3C. In either event, the timed interval is initiated when the evaporator pressure $P_e$ falls below the entry pressure $P_{LCH}$.

If the timed interval of the pull-down phase exceeds a reference interval such as 6 seconds, the refrigerant charge is deemed adequate and the test is terminated. However, if the 20 PSI pressure differential is achieved in 6 seconds or less, an inadequate level of refrigerant charge is indicated. The relatively fast pull-down occurs when the charge is so low that the refrigerant supplied to the inlet of evaporator 18 is predominantly gaseous. Since there is little or no liquid refrigerant to evaporate, the 20 PSI pressure differential is quickly achieved Each time the pressure differential is achieved within the 6-second reference interval, the count in a nonvolatile (electrically erasable or $E^2$) memory location of micro-computer 54 is incremented. If the pull-down duration exceeds the 6-second reference interval, the nonvolatile count, if any, is decremented. When the count exceeds a specified threshold, the compressor 12 is disabled, and further operation is prevented until the nonvolatile count is reset by a service technician when the system is re-charged with refrigerant.

Figure 3B:
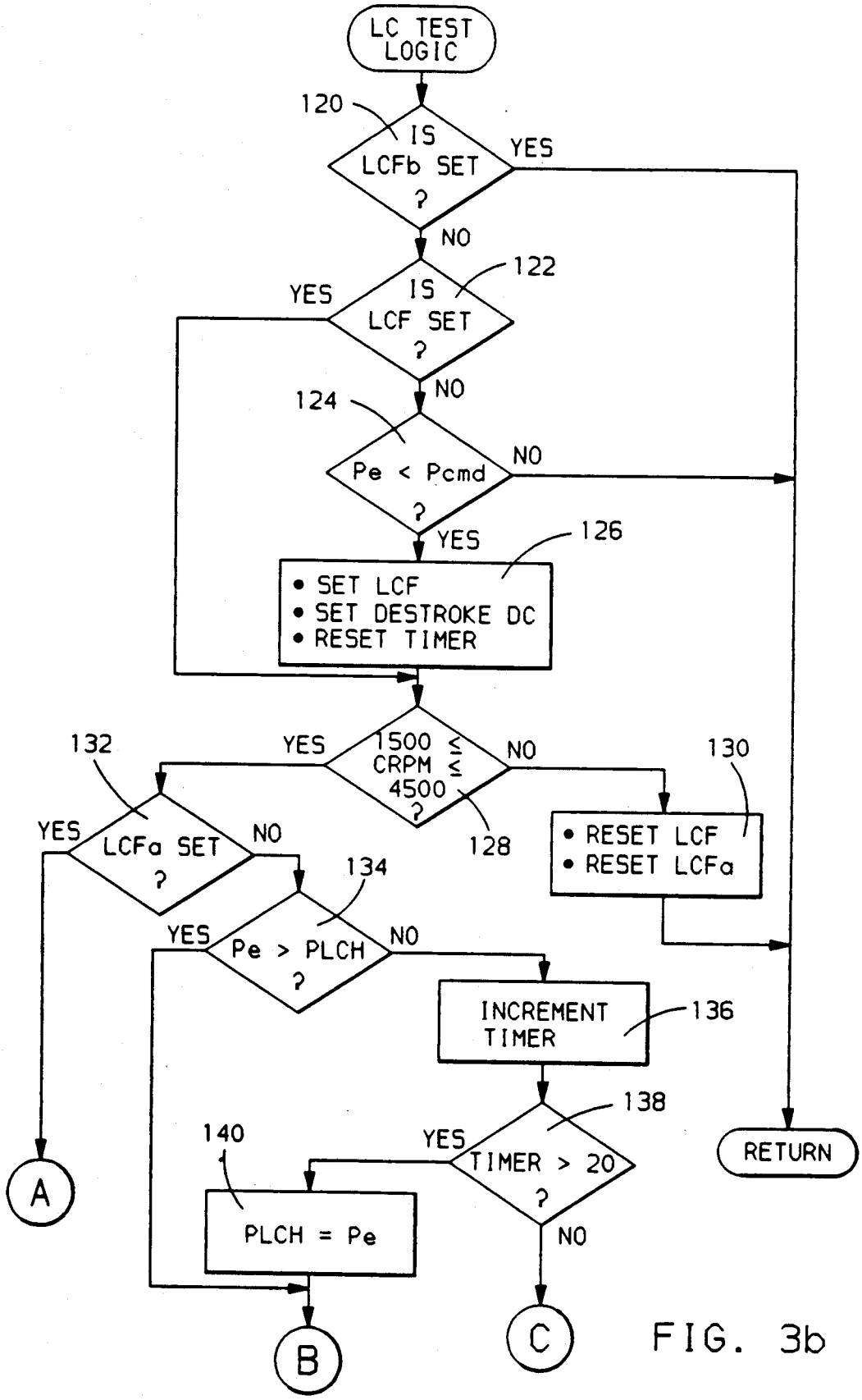
FIGS. 3A, 3B and 3C are flow diagrams representative of computer program instructions executed by computer-based control unit of FIG. 1 in carrying out the control of this invention.
Figure 3A:
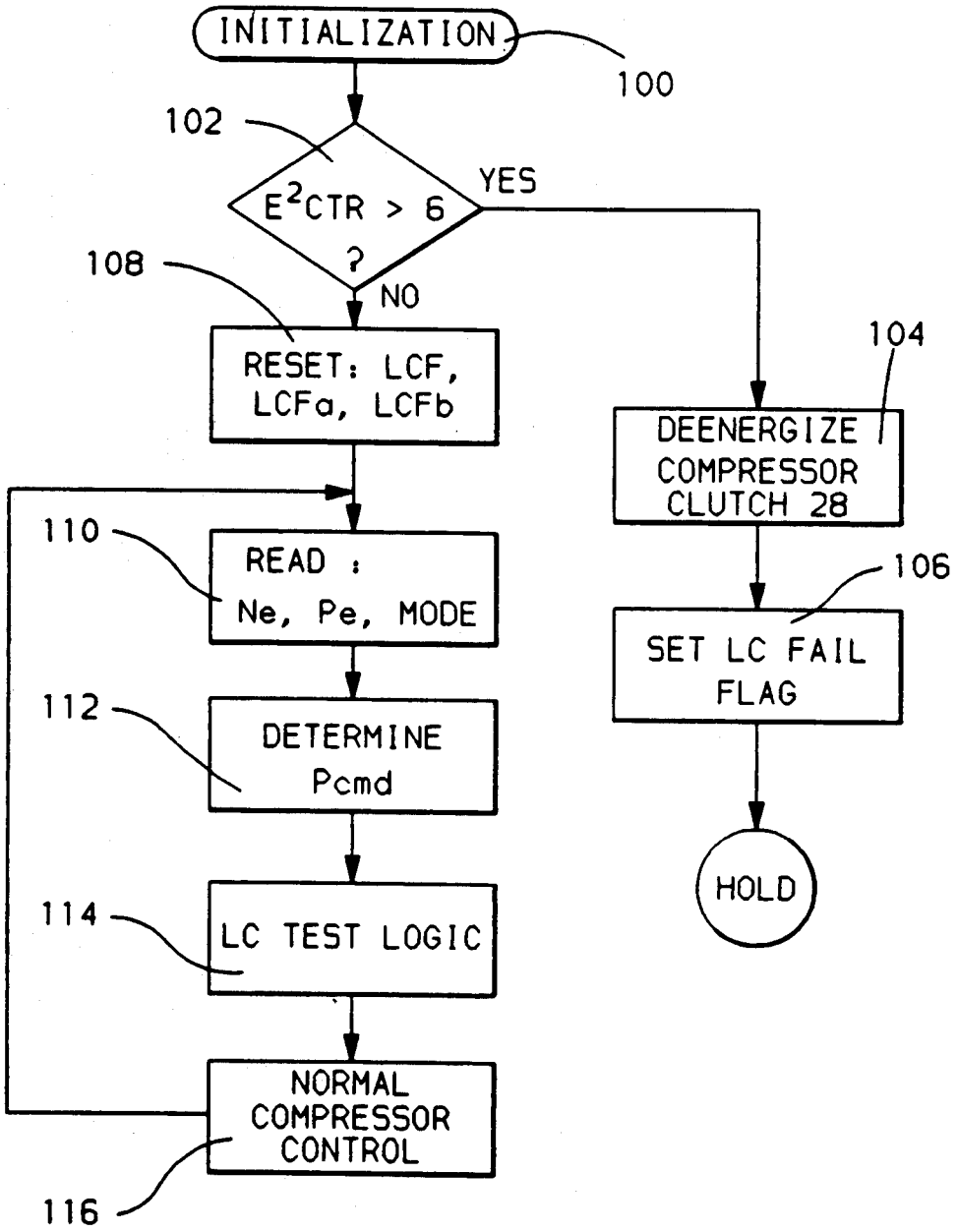
Figure 3C:
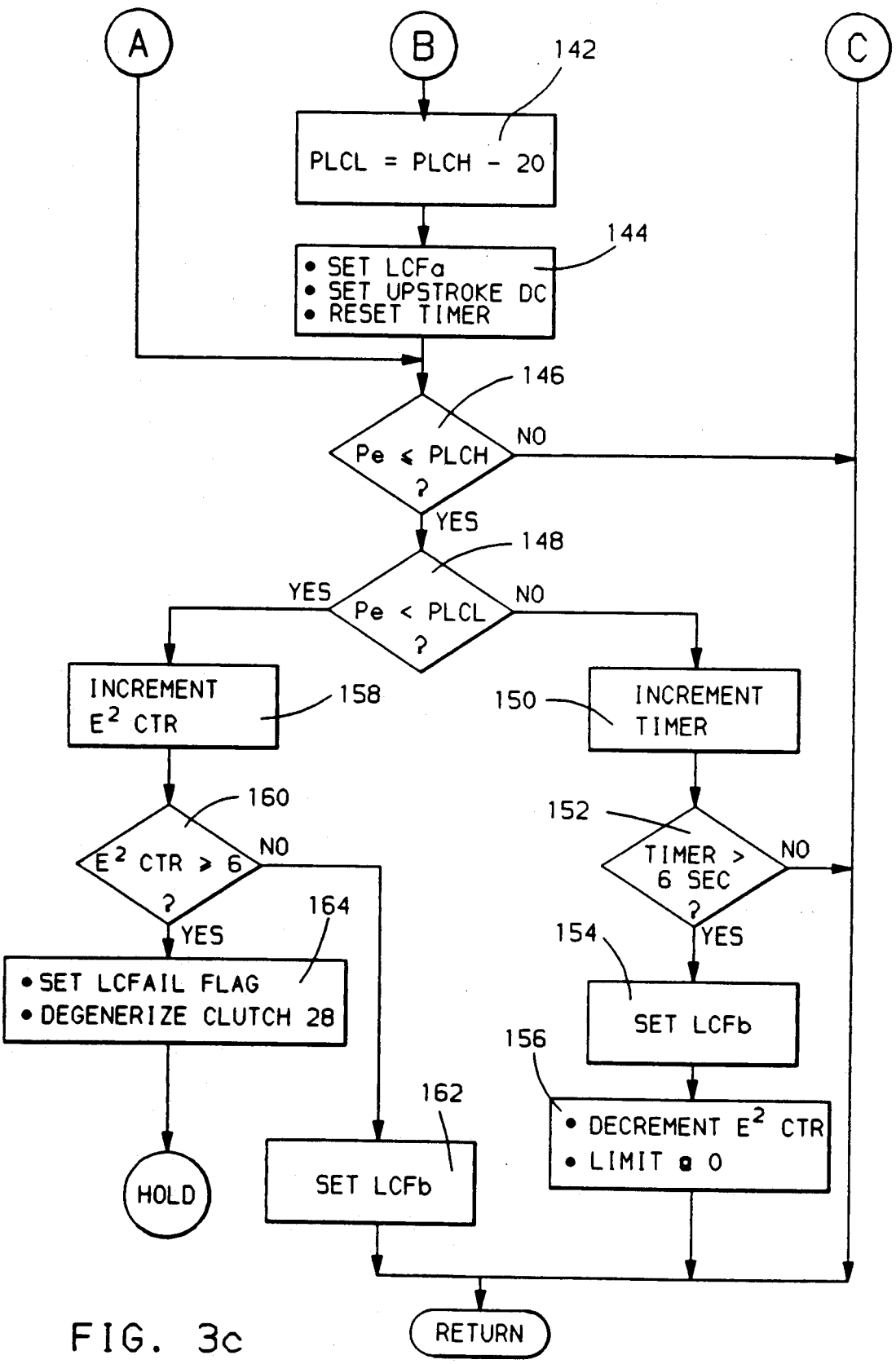

The flow diagrams of FIGS. 3A–3C represent computer program instructions executed by the micro-computer 54 of control unit 30 in carrying out the low charge protection method of this invention. FIG. 3A depicts a main or executive program loop, and FIGS. 3B–3C together depict a program routine for carrying out the low charge routine.

Referring first to FIG. 3A, the reference numeral 100 generally designates a set of instructions executed at the initiation of each period of vehicle operation for initializing the various memory registers, flags and timer values employed in the control. If the count in the $E^2$ memory is greater than a threshold count (such as 6), as determined by the decision block 102, the blocks 104 and 106 are executed to de-energize the compressor clutch 28 and set a LOW CHARGE (LC) FAIL flag. In such case, further compressor control is suspended until the $E^2$ memory location is reset by a service technician.

If the $E^2$ count is less than the reference count, the refrigerant charge is presumed to be adequate, and the block 108 is executed to reset the low charge test flags LCF, LCFa and LCFb. Thereafter, the blocks 110–116 are sequentially and repeatedly executed, as indicated by the flow diagram lines. The system input signals such as Ne, $P_e$ and MODE are read at block 110; the pressure command PCMD is determined at block 112; the low charge test logic of this invention is executed at block 114; and the normal compressor displacement control is executed at block 116. A detailed description of a representative pressure command determination is given in U.S. Ser. No. 399,039, filed Aug. 28, 1989, now U.S. Pat. No. 4,969,039 and assigned to the assignee of the present invention. A detailed description of a representative normal compressor control is given in a co-pending patent application, U.S. Ser. No. 533,303, filed June 4, 1990, also assigned to the assignee of the present invention.

In the low charge test logic set forth in FIGS. 3B–3C, the three flags referred to above are employed to designate the current state of the test Each of the flags is initialized (reset) by the block 108 of FIG. 3A. The first flag LCF is set at the initiation of the set-up phase. The second flag LCFa is set at the initiation of the pull-down phase. The third flag LCFb is set at the termination or completion of the test.

Referring to FIGS. 3B–3C, the decision blocks 120–122 are first executed to determine the status of the low charge test. If the LCFb flag is set, the test has been completed, and the remainder of the routine is skipped. If the LCF flag is not set, the test has not yet started, and the blocks 124–126 are executed to (1) set the LCF flag, (2) down-stroke the compressor 12, and (3) reset the time-out timer as soon as the evaporator outlet pressure $P_e$ falls below the pressure command value PCMD, thereby initiating the set-up phase of the test.

Once set-up phase is initiated, as indicated by the set state of the LCF flag, the decision block 128 is executed to determine if the compressor speed (CRPM) is in the range of 1500–4500 RPM. If not, the low charge test cannot be reliably performed, and the block 130 is executed to reset the LCF and LCFa flags, terminating the test.

If the compressor speed is within the normal range, and the pull-down phase has not been initiated (as determined at decision block 132), decision block 134 is executed to determine if the evaporator pressure $P_e$ has reached the entry pressure $P_{LCH}$. If not, the block 136 is executed to increment the time-out timer. If the time-out timer is incremented to a count representing more than approximately 20 seconds before $P_e$ reaches the entry pressure $P_{LCH}$, as determined by the decision blocks 134 and 138, the block 140 is executed to reset the entry pressure $P_{LCH}$ to the current value of $P_e$. In either event, the exit pressure $P_{LCL}$ is then defined as ($P_{LCH}$—20 PSI) by block 142, and the block 144 is executed to initiate the pull-down phase of the test. To this end, block 144 sets the LCFa flag, initiates up-stroking of compressor 12 and resets the timer so that it can be used to time the pull-down interval.

Once the pull-down phase of the test has been initiated, and the evaporator pressure $P_e$ has fallen below the entry pressure $P_{LCH}$ (as determined at decision block 146), the decision block 148 is executed to determine if $P_e$ has reached the exit pressure $P_{LCL}$. If not, the block 150 is executed to increment the pull-down timer. If the timer count reaches a value representative of approximately 6 seconds before $P_e$ reaches the exit pressure $P_{LCL}$, as determined by blocks 148 and 152, the refrigerant charge is deemed adequate and the blocks 154–156 are executed to set the LCFb flag and decrement the $E^2$ count, if any, completing the routine.

If $P_e$ reaches the exit pressure $P_{LCL}$ before the timer count reaches a value representative of approximately 6 seconds, as determined by blocks 148 and 152, the refrigerant charge is deemed inadequate to protect the compressor 12, and the block 158 is executed to increment the $E^2$ count. Until the incrementing causes the count to exceed a reference count such as 6, as determined at block 160, continued compressor operation is permitted and the block 162 is executed to set the LCFb flag. When the count reaches the reference count, the block 164 is executed to set the LOW CHARGE (LC) FAIL flag and to deenergize the clutch 28. Further compressor operation is suspended until the $E^2$ memory location is reset by a service technician.

In operation, the low charge protection of this invention provides a reliable indication of the adequacy of the refrigerant charge, and protects the variable displacement compressor 12 from damage due to extended operation at low refrigerant charge levels. At marginal charge levels, the system may pass and fail successive low charge tests, and the $E^2$ count effectively integrates the low charge indications over time. In this way, the routine of this invention provides adequate protection of the compressor without causing unnecessary or nuisance interruptions.

While this invention has been described in reference to the illustrated embodiment, it is expected that various modifications will occur to those skilled in the art. In this regard, it will be understood that systems incorporating such modifications may fall within the scope of the present invention, which is defined by the appended claims.

The embodiments of the invention in which an exclusive property or privilege is claimed are defined as follows:

1. In a vehicle air conditioning system including a refrigerant compressor, the displacement of which is controlled to maintain a measured refrigerant vapor pressure at a desired value, a control method for protecting said compressor from damage due to continued operation with insufficient refrigerant charge, comprising the steps of:

controlling the compressor to a minimum displacement once the vapor pressure of the refrigerant reaches the desired value, to thereby initiate a set-up period in which the measured vapor pressure is permitted to increase;

controlling the compressor to a maximum displacement once the measured vapor pressure reaches a first reference pressure, thereby to terminate said set-up period and define a pull-down period in which the measured vapor pressure is decreased by the compressor at a maximum rate;

measuring a pull-down time required for the measured vapor pressure to decrease from the first reference pressure to a second reference pressure lower than said first reference pressure; and indicating the detection of an insufficient refrigerant condition if the pull-down time is shorter than a reference pull-down time characteristic of a sufficient refrigerant condition.

2. The control method set forth in claim 1, wherein the compressor is independently controlled to said maximum displacement to terminate said set-up period and initiate an override pull-down period if the measured pressure fails to reach said first reference pressure within a specified time commencing with the initiation of said set-up period.

3. The control method set forth in claim 2, wherein the second reference pressure in the case of said override pull-down period is determined in relation to the measured vapor pressure at the initiation of said override pull-down period.

4. In a vehicle air conditioning system including a refrigerant compressor and control means for enabling and disabling operation of the compressor, and for controlling the displacement of the compressor to maintain a measured refrigerant vapor pressure at a desired value, a control method for protecting said compressor from damage due to continued operation with insufficient refrigerant charge, comprising the steps of:

controlling the compressor to a minimum displacement in each period of vehicle operation in which the compressor is enabled once the vapor pressure of the refrigerant reaches the desired value, to thereby initiate a set-up period in which the measured vapor pressure is permitted to increase;

controlling the compressor to a maximum displacement once the measured vapor pressure reaches a first reference pressure, thereby to terminate said set-up period and define a pull-down period in which the measured vapor pressure is decreased by the compressor at a maximum rate;

measuring a pull-down time required for the measured vapor pressure to decrease from the first reference pressure to a second reference pressure lower than said first reference pressure;

comparing the measured pull-down time to a reference pull-down time characteristic of a sufficient refrigerant condition to indicate if the refrigerant charge is adequate or inadequate; and disabling operation of the compressor when the number of inadequate refrigerant charge indications exceeds the number of adequate refrigerant charge indications by a specified amount.

5. The control method set forth in claim 4, wherein the compressor is independently controlled to said maximum displacement to terminate said set-up period and initiate an override pull-down period if the measured pressure fails to reach said first reference pressure within a specified time commencing with the initiation of said set-up period.

6. The control method set forth in claim 5, wherein the second reference pressure in the case of said override pull-down period is determined in relation to the measured vapor pressure at the initiation of said override pull-down period.

* * * * *